US011413665B2

(12) United States Patent
Frost

(10) Patent No.: US 11,413,665 B2
(45) Date of Patent: Aug. 16, 2022

(54) COMMERCIAL VACUUM HOSE CLEARING APPARATUS

(71) Applicant: Shane D. Frost, Orderville, UT (US)

(72) Inventor: Shane D. Frost, Orderville, UT (US)

( * ) Notice: Subject to any disclaimer, the term of this patent is extended or adjusted under 35 U.S.C. 154(b) by 140 days.

(21) Appl. No.: 16/529,568

(22) Filed: Aug. 1, 2019

(65) Prior Publication Data

US 2020/0038920 A1 Feb. 6, 2020

Related U.S. Application Data

(60) Provisional application No. 62/713,675, filed on Aug. 2, 2018.

(51) Int. Cl.
*B08B 9/055* (2006.01)

(52) U.S. Cl.
CPC ..... *B08B 9/0558* (2013.01); *B08B 9/0553* (2013.01); *B08B 2209/032* (2013.01); *B08B 2209/055* (2013.01)

(58) Field of Classification Search
CPC ..... A47L 9/248; B08B 2209/032; B08B 2209/055; B08B 9/0321; B08B 9/0553; B08B 9/0558
USPC ..... 134/166 R, 167 R, 168 R, 169 R, 169, 134/169 C; 15/104.061; 239/589, 597
See application file for complete search history.

(56) References Cited

U.S. PATENT DOCUMENTS 3,606,169 A * 9/1971 West ..... B05B 1/02 239/597
4,756,324 A * 7/1988 Larsson ..... B08B 9/0495 134/167 C
4,809,732 A * 3/1989 Buehler ..... A01G 25/00 137/209
5,158,101 A * 10/1992 Sakka ..... B01L 13/00 134/182
5,203,361 A * 4/1993 Tickle ..... A47K 11/10 134/167 C
5,992,432 A * 11/1999 Horger ..... B08B 9/0495 134/167 C
6,089,243 A * 7/2000 Horger ..... B08B 9/0495 134/169 C
6,609,531 B2 * 8/2003 Lesko ..... B08B 9/0321 122/379
6,681,783 B2 * 1/2004 Kawazoe ..... A61B 1/122 134/169 C (Continued)

FOREIGN PATENT DOCUMENTS

CN 201375979 Y * 1/2010

OTHER PUBLICATIONS

CN 201375979 Y Machine Translation via EPO, produced on Jul. 3, 2021. (Year: 2021).*

*Primary Examiner* — Duy Vu N Deo
*Assistant Examiner* — Christopher Remavege
(74) *Attorney, Agent, or Firm* — Gurr Brande & Spendlove, PLLC; Robert A. Gurr

(57) ABSTRACT

A hose clearing apparatus has a cylindrical body, a fluid coupler on the rear side, and a fluid nozzle on the front side. A method of clearing a hose involves coupling a fluid to the fluid coupler, adjusting the fluid nozzle to achieve the desired spray, powering on the vacuum with the hose coupled thereto, inserting the front of the body and accompanying nozzle into the hose, and allowing the hose to traverse through the hose.

1 Claim, 6 Drawing Sheets

(56) References Cited

U.S. PATENT DOCUMENTS

| | | | | |
|---|---|---|---|---|
| 8,298,349 | B2 * | 10/2012 | Wojciechowski, III | B05B 13/0636 134/167 C |
| 8,366,835 | B2 * | 2/2013 | Larsson | B08B 9/0495 134/169 C |
| 8,499,409 | B2 * | 8/2013 | Reining | B01D 46/71 134/198 |
| 8,635,849 | B2 * | 1/2014 | Tassone | F01D 25/002 134/169 R |
| 8,931,558 | B1 * | 1/2015 | Harper | E21B 37/00 166/311 |
| 9,314,952 | B2 * | 4/2016 | Walker | B05B 1/267 |
| 2003/0056816 | A1 * | 3/2003 | Lesko | B08B 9/0321 134/167 C |
| 2008/0230100 | A1 * | 9/2008 | Patterson | F28G 1/163 134/198 |
| 2009/0039181 | A1 * | 2/2009 | Auer, Jr. | B08B 3/026 239/589 |
| 2014/0052101 | A1 * | 2/2014 | Stroup | A61M 39/26 251/324 |
| 2015/0102126 | A1 * | 4/2015 | Russell | B05B 1/08 239/203 |
| 2019/0224724 | A1 * | 7/2019 | Gromes, Sr. | B05B 1/1636 |

* cited by examiner

COMMERCIAL VACUUM HOSE CLEARING APPARATUS

CROSS-REFERENCE TO RELATED APPLICATIONS

This application claims the benefit of U.S. Provisional Application Ser. No. 62/713,675, filed on Aug. 2, 2018, which is incorporated herein by reference.

TECHNICAL FIELD

The present disclosure relates to commercial vacuum hoses. More particularly, the present disclosure relates to an apparatus for clearing debris and build-up from the inside of the vacuum hose.

BACKGROUND

Commercial carpet cleaning systems typically rely on hoses of significant length. Over time, sediment can build-up in the hose, and debris can become lodged therein. As a result, the hose not only becomes less efficient, but is significantly heavier. This increases the time and effort it takes a worker to clean carpets. Because of the significant length of the hose, methods of cleaning the inside, such as flushing, are ineffective. Because of this problem, simple devices, such as a rag tied to a rope, have been used to attempt to clear the hose. However, merely pulling a rag through the hose using a rope also fails to dislodge debris or adequately remove build-up. Because an adequate method of clearing the hose is not found in the art, it is common for carpet cleaners to simply discard their hoses and buy new hoses when they become overly clogged. This is expensive and adds unneeded waste to landfills.

Accordingly, there remains a need for a hose clearing device that can adequately clean the full-length of the hose, thereby extending the life of the hose. This allows a worker to clean carpets more efficiently and with less cost. The present invention seeks to solve these and other problems.

SUMMARY OF EXAMPLE EMBODIMENTS

In one embodiment, a hose clearing apparatus comprises a cylindrical body, the body comprising a fluid coupler on the rear and a fluid nozzle on the front.

In one embodiment, a method of clearing a hose using a hose clearing apparatus comprises coupling a fluid to the fluid coupler, adjusting the fluid nozzle to achieve the desired spray, powering on the vacuum with the hose coupled thereto, inserting the front of the body and accompanying nozzle into the hose, and allowing the hose clearing apparatus to traverse through the hose. In a preferred embodiment, the circumference of the body exceeds the size of the vacuum inlet, thereby prohibiting the hose clearing apparatus from entering and damaging the vacuum.

DETAILED DESCRIPTION OF EXAMPLE EMBODIMENTS

Figure 1:
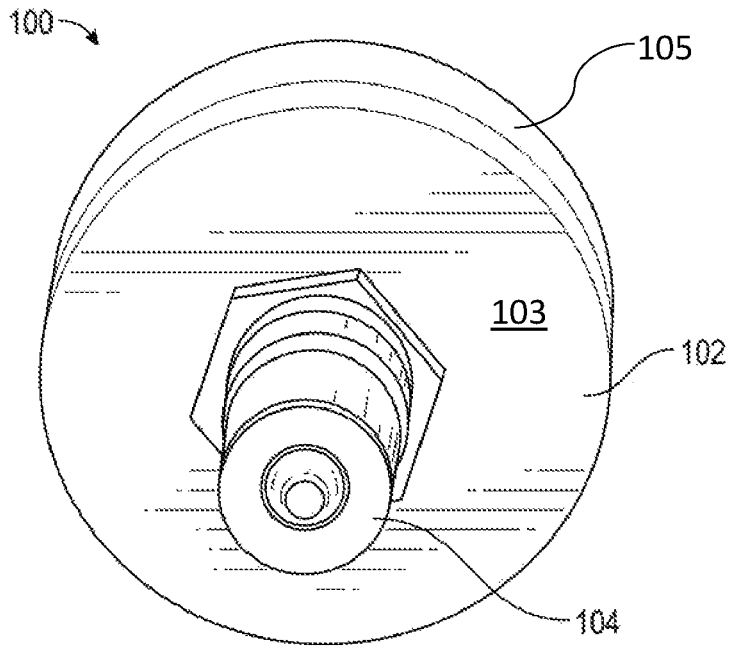
FIG. 1 is a rear perspective view of a hose clearing apparatus.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As previously discussed, there is a need for a hose clearing device that can adequately clean the full-length of a commercial vacuum hose, thereby extending the life of the hose. This allows a worker to clean carpets more efficiently and with less cost. The hose clearing apparatus disclosed herein solves these needs and others.

Figure 2:
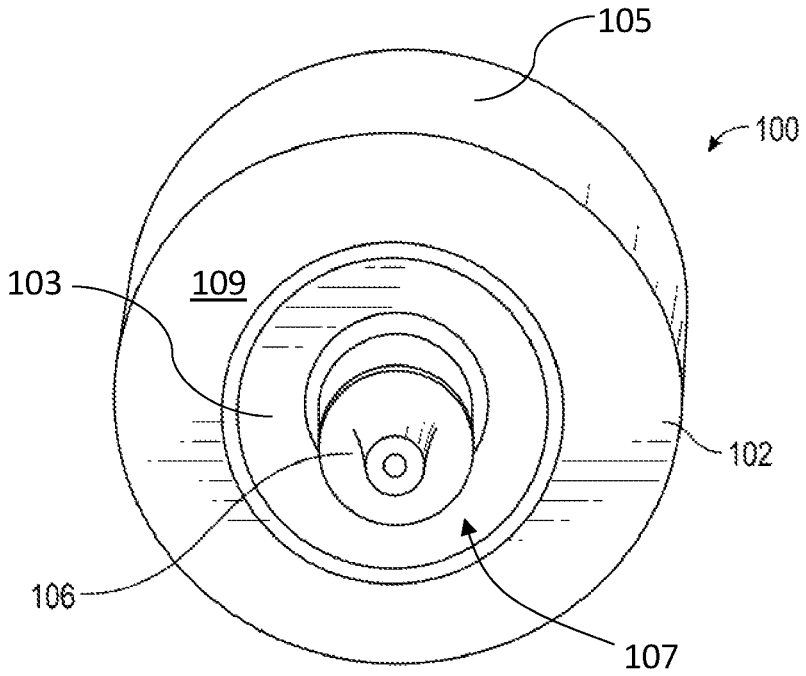
FIG. 2 is a front perspective view of a hose clearing apparatus.
Figure 3:
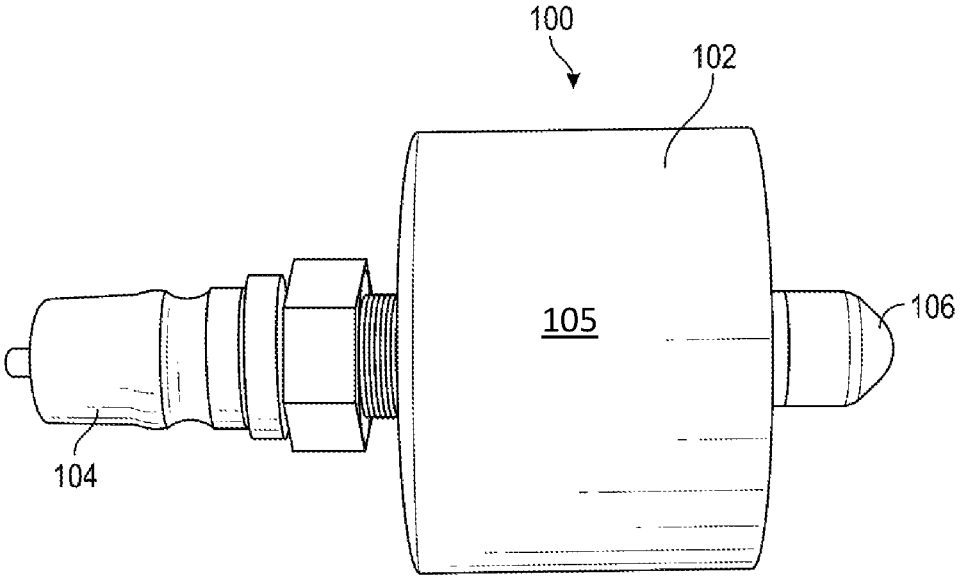
FIG. 3 is a side elevation view of a hose clearing apparatus.
Figure 4:
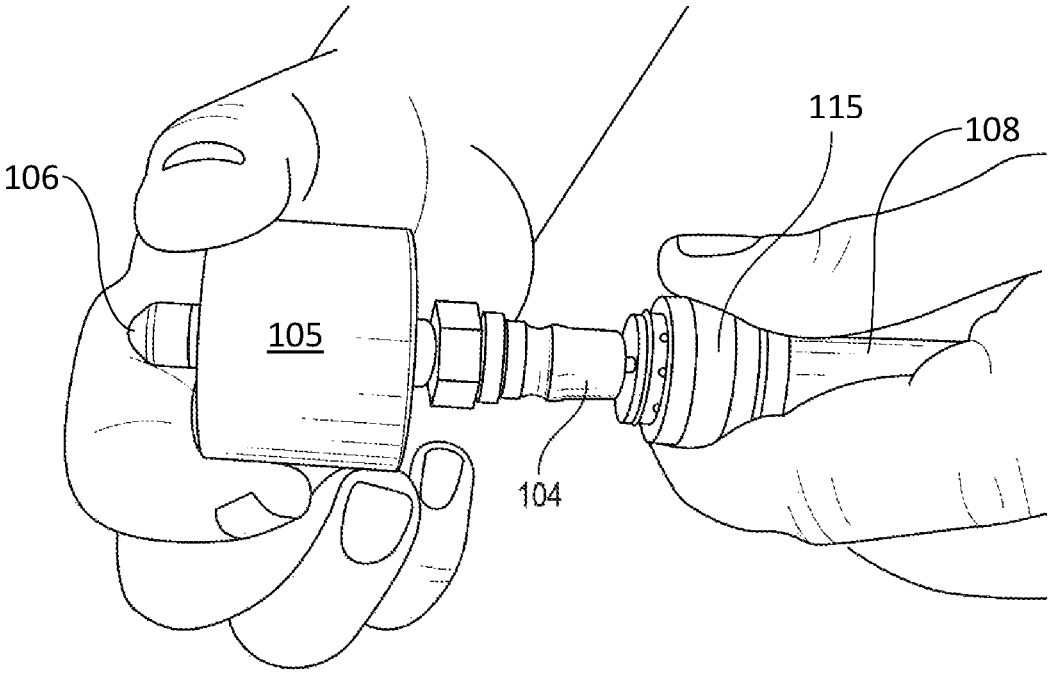
FIG. 4 is a side perspective view of a hose clearing apparatus with a fluid hose being coupled to a fluid coupler thereof.

In one embodiment, as shown in FIGS. 1-3, a hose clearing apparatus 100 comprises a cylindrical body 102, a fluid coupler 104 on the rear side of the body 102 and a fluid nozzle 106 on the front side of the body 102. The body 102 may be manufactured from aluminum so as to be lightweight and not susceptible to corrosion. However, other materials may also be used, such as plastics, carbon fibers, metals, or wood. The body 102 may comprise a rear wall 103 with cylindrical sidewall 105 extending therefrom. The sidewall 105 may have a center bore 107, creating a void for receiving the nozzle 106. The sidewall 105 may comprise a front lip 109. Front lip 109 aids in clearing debris as the hose clearing device 100 traverses through a hose by pushing debris. It will be understood that the nozzle 106 and fluid coupler 104 are coupled to the body 102 by passing through an aperture in the rear wall 103 (not visible). For example, the nozzle 106 may be threadably coupled to the fluid coupler 104. However, in other embodiments, the hose clearing apparatus 100 may be of single manufacture or with at least one of the coupler and/or nozzle being an integral part of the body 102. The fluid coupler 104 may be of any standard coupler in the art, including a quick-coupler, threaded coupler, or similar. The fluid coupler 104 may also be male or female.

Figure 5:
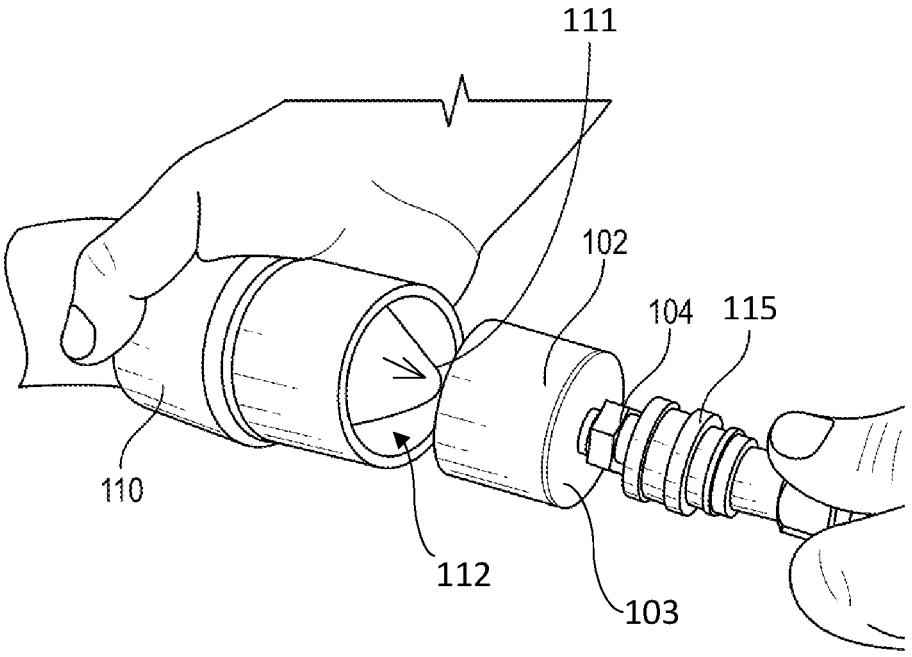
FIG. 5 is a rear perspective view of a hose clearing apparatus with fluid exiting the nozzle, in preparation for entering a vacuum hose.
Figure 6:
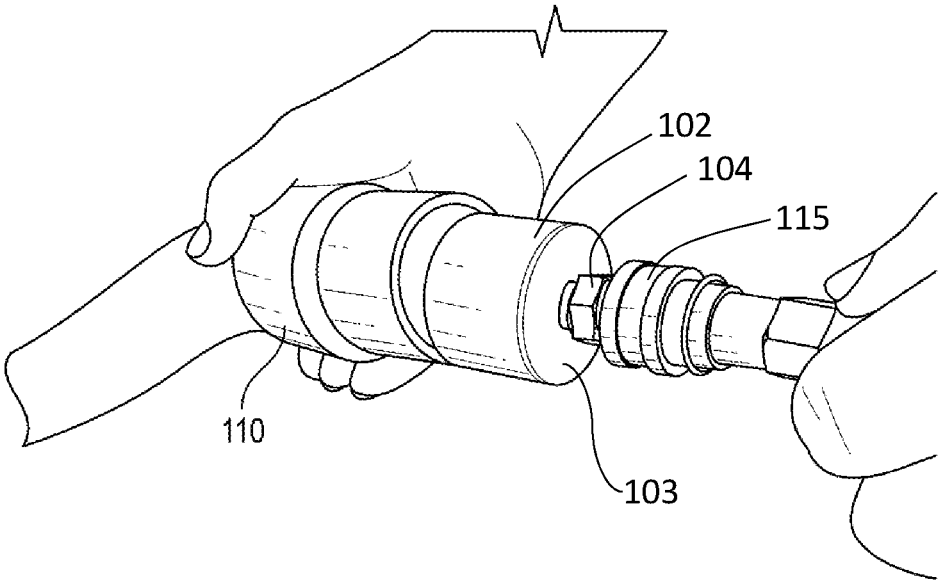
FIG. 6 is a rear perspective view of the hose clearing apparatus entering a vacuum hose.
Figure 7:
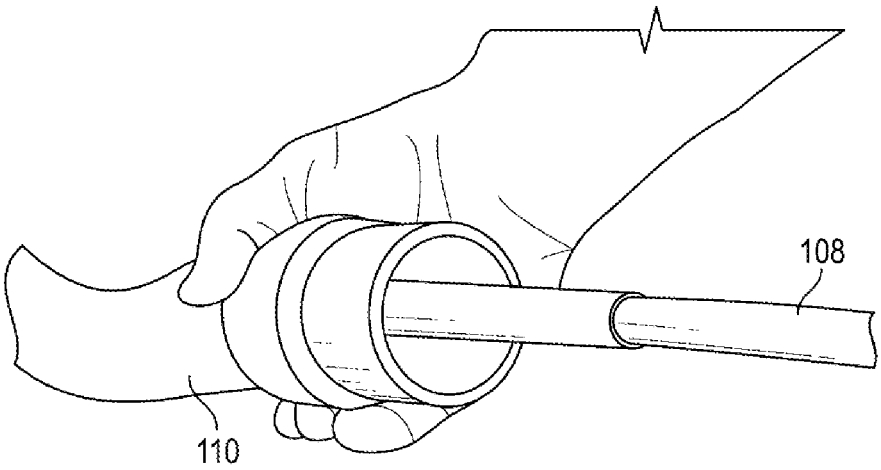
FIG. 7 is perspective view of a hose clearing apparatus inside of a hose, with the fluid hose following therein.

In one embodiment, as shown in FIGS. 4-8, a method of clearing a vacuum hose using a vacuum hose clearing apparatus 100 comprises coupling a fluid hose 108 to the fluid coupler 104. As used herein, the word fluid refers to any fluid, including liquids and gases. In one embodiment, water is the preferred fluid due to its availability and low cost. However, cleaning chemicals or other agents may also be used. Once the fluid hose 108 is coupled to the fluid coupler 104 (e.g., standard quick-coupler 115), the fluid nozzle 106 may be adjusted to achieve the desired spray. As shown in FIG. 5, the nozzle 106 may be of a cone jet sprayer, creating a cone spray 111 which sufficiently sprays the inner circumference of the vacuum hose 110. With the desired spray achieved, the vacuum hose 110 is coupled to the vacuum and the vacuum is powered on. As shown in FIGS. 5-6, the user then inserts the hose cleaning apparatus 100, nozzle 106 first, into the hose opening 112. Preferably, the outer circumference of the sidewall 105 is just smaller than the inner diameter of the hose 110. As a result, the vacuum pressure pulls the hose clearing apparatus 100 through the vacuum hose 110. As the hose clearing apparatus 100 traverses through the hose 110, the spray 111 dislodges debris and sediment, which then gets sucked by the vacuum through the hose 110 as well. The debris and sediment are then received into the vacuum's container. In addition, the body 102 also aids in clearing debris as the body 102 is sucked through the vacuum hose 110. As understood, this method of clearing a vacuum hose is substantially better than the prior art. The combined use of a sprayer (i.e., nozzle 106) and body 102 that can be sucked, using vacuum pressure, through the vacuum hose 110 while the vacuum simultaneously collects the debris and water, is a significant improvement in the art, leading to a prolonged life for the vacuum hose 110, which saves cost for a user while reducing environmental impact (less plastic waste).

Figure 8:
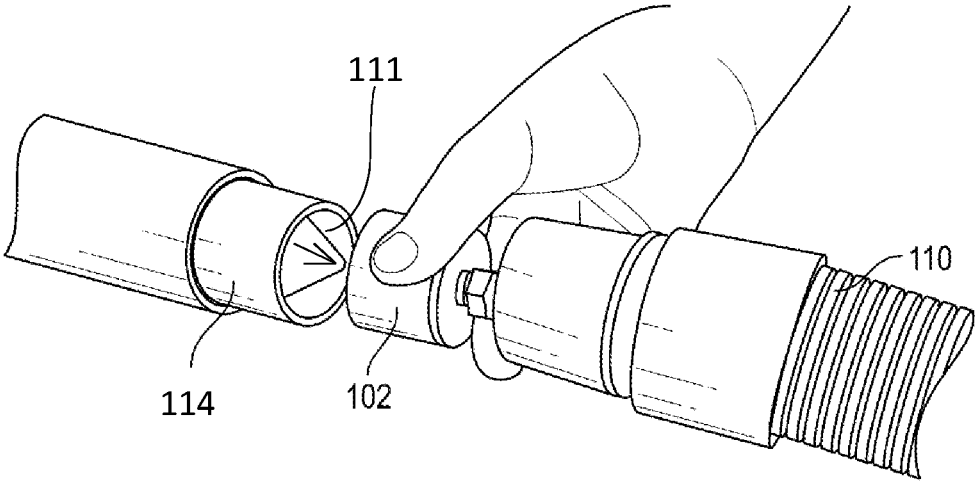
FIG. 8 is a perspective view of a hose clearing apparatus exiting the hose at the inlet of the vacuum.

In some scenarios, it may be beneficial for a user to maintain control of the speed with which the hose clearing apparatus 100 traverses through the vacuum hose 110. This can be accomplished by the user maintaining a grip on the fluid hose 108. This may allow the hose clearing apparatus 100 to move slower through the hose, clearing more debris. As shown in FIG. 8, once the hose clearing apparatus 100 reaches the vacuum inlet 114, the process is complete. In a preferred embodiment, the sidewall 105 has an outer circumference that exceeds the inner diameter of the vacuum inlet 114, thereby prohibiting the hose clearing apparatus 100 from entering and damaging the vacuum. With the hose clearing apparatus 100 now at the vacuum inlet, the hose clearing apparatus 100 may be disconnected so that the fluid hose 108 may be easily withdrawn from within the vacuum hose 110. These steps may be repeated for any number of hoses and hose lengths, depending upon the length of the fluid hose 108 and the vacuum suction pressure.

While the nozzle 106 has been described as cone-shaped and adjustable, such is not required. In other words, the nozzle may have a fixed (non-adjustable) cone spray pattern; in another embodiment, the nozzle may be adjustable to non-cone shaped spray patterns. Further, while water and chemical liquids were described, pressurized air may also be used without departing herefrom.

Figure 9:
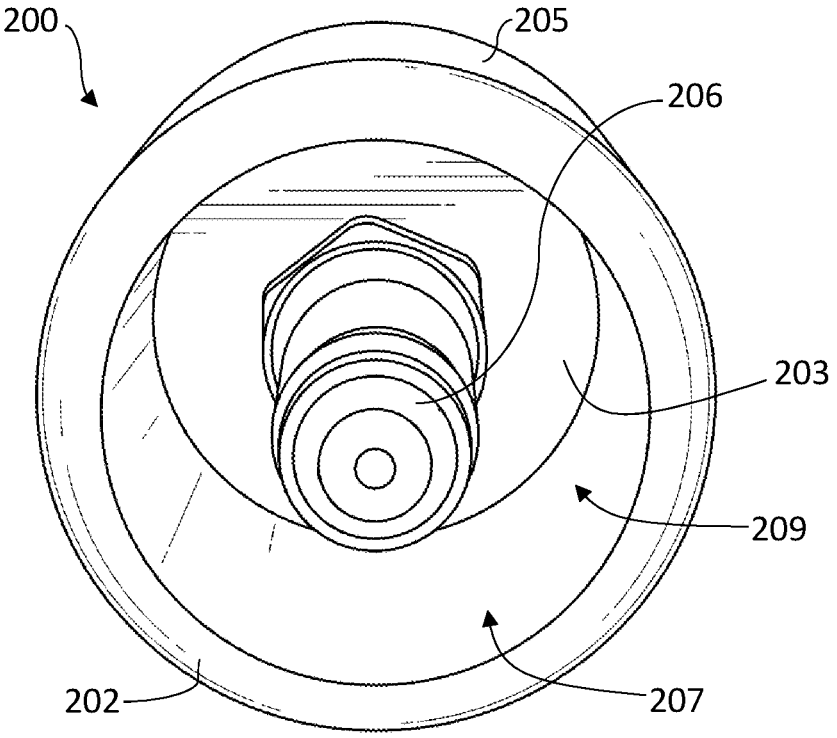
FIG. 9 is a front perspective view of a hose clearing apparatus.
Figure 10:
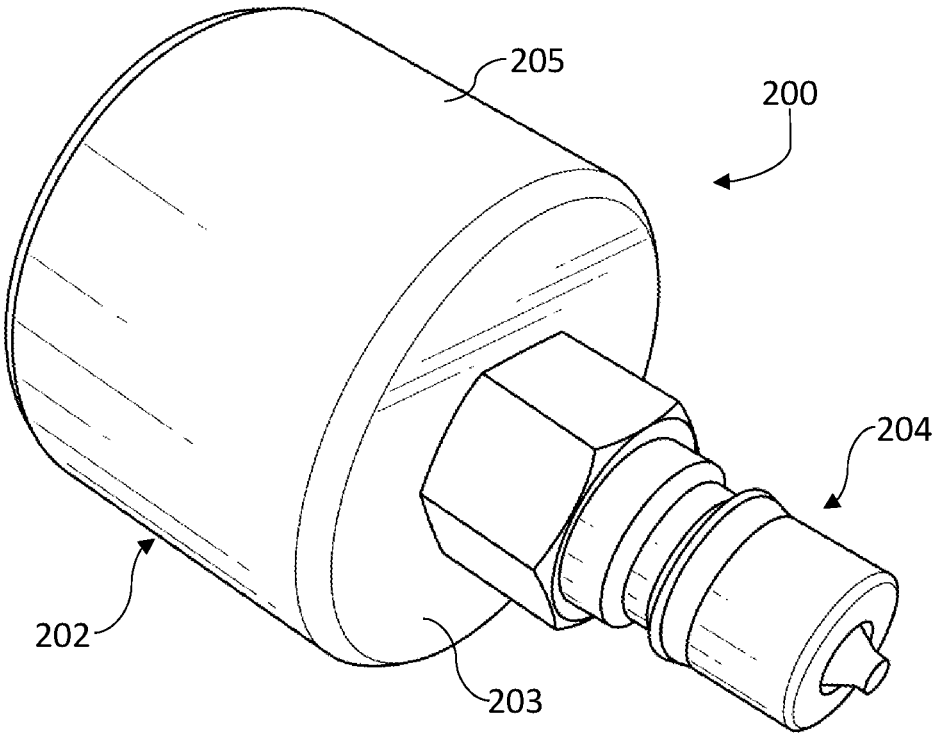
FIG. 10 is a rear perspective view of a hose clearing apparatus.
Figure 11:
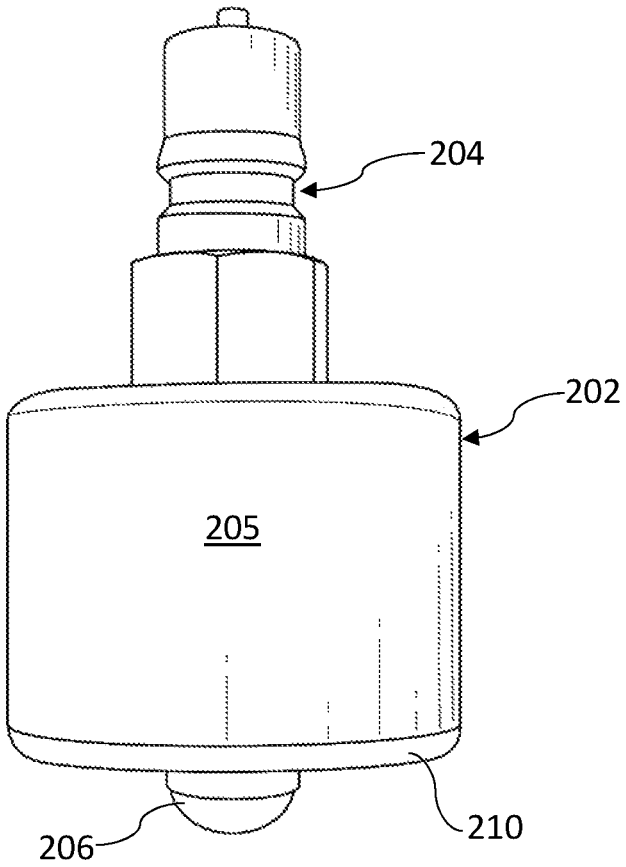
FIG. 11 is a side elevation view of a hose clearing apparatus.

FIGS. 9-11 illustrate a hose clearing apparatus 200 comprising a cylindrical body 202, a fluid coupler 204 on the rear side of the body 202 and a fluid nozzle 206 on the front side of the body 202. The body 202 comprises a rear wall 203 with cylindrical sidewall 205 extending therefrom. The sidewall 205 has a center bore 207, creating a void 209 for receiving the nozzle 206. As shown in FIG. 11, the nozzle 206 may extend longitudinally beyond the front edge 210 of the sidewall 205, which ensures that the fluid exiting therefrom does not contact the sidewall 205 and instead contacts the inner circumference of the vacuum hose. It will be understood that the nozzle 206 may be threadably coupled to the fluid coupler 204 by passing through an aperture in the rear wall 203. For example, the nozzle 206 may comprise a male component that passes through the rear wall 203. The fluid coupler 204 may comprise a female end for coupling to the male end of the nozzle 206. This configuration secures and centers the nozzle 206 within the void 209.

While the fluid nozzle 206 has been illustrated as within a void 209 created by a bore 207, such is not required. In other words, the body need not have a bore and may instead be a puck with the nozzle and fluid coupler extending from each side of the puck, neither of which would be within a void created by sidewalls. Alternately, the fluid coupler may be within a void, rather than the fluid nozzle.

Accordingly, it is clear from the foregoing description that the hose clearing apparatus described herein solves the need for a hose clearing device that can adequately clean the full-length of a hose, extending the life of the hose. This allows a worker to clean carpets more efficiently and with less cost. While vacuum hoses were used as an example herein, it will be appreciated that the hose cleaning apparatus described herein may be used with any type of hose. For example, if used with a non-vacuum hose, the hose clearing apparatus may advance through the hose by a user exerting a force on the attached fluid hose, pushing the hose clearing apparatus and fluid hose through the hose to be cleaned. However, it will be understood that in the preferred embodiment, the outer circumference of the hose clearing device 100, 200 is slightly less than the inner circumference of a vacuum hose so that vacuum pressure pulls the hose clearing device through the vacuum hose, which is an improvement over methods in the art.

Exemplary embodiments are described above. No element, act, or instruction used in this description should be construed as important, necessary, critical, or essential unless explicitly described as such. Although only a few of the exemplary embodiments have been described in detail herein, those skilled in the art will readily appreciate that many modifications are possible in these exemplary embodiments without materially departing from the novel teachings and advantages herein. Accordingly, all such modifications are intended to be included within the scope of this invention.

What is claimed is:

1. A vacuum hose clearing apparatus, comprising:

a cylindrical body having a rear wall, a sidewall extending from the rear wall, and a center bore forming a void;

a fluid nozzle extending longitudinally from within the void formed by the center bore, the fluid nozzle extending beyond a front edge of the sidewall;

a fluid coupler extending from the rear wall in a direction opposite the fluid nozzle;

wherein the fluid nozzle is coupled to the fluid coupler; and wherein the outer circumference of the cylindrical body is configured to be less than the inner circumference of a commercial vacuum hose to be cleared, the cylindrical body configured to pass through the commercial vacuum hose from a first end to a second end, the fluid nozzle configured to spray interior sidewalls of the commercial vacuum hose.

* * * * *